United States Patent [19]

Nichola

[11] 4,019,765

[45] Apr. 26, 1977

[54] DOOR SECURITY GUARD

[75] Inventor: Vernon A. Nichola, Dodgeville, Mich.

[73] Assignee: Nichola-Vern, Inc., Dodgeville, Mich.

[22] Filed: Oct. 29, 1975

[21] Appl. No.: 627,013

[52] U.S. Cl. ..... 292/338; 248/354 P

[51] Int. Cl.[2] ..... E05C 17/44

[58] Field of Search ..... 70/94; 248/351, 354 R, 248/354 P, 354 S; 292/262, 265–267, 288, 338, 339; 254/39

[56] References Cited

UNITED STATES PATENTS

| | | | |
|---|---|---|---|
| 598,405 | 2/1898 | Williams | 292/339 |
| 942,592 | 12/1909 | Schneider | 248/354 S UX |
| 1,304,394 | 5/1919 | Shyer | 292/338 |
| 1,615,357 | 1/1927 | Bruhn et al. | 292/338 |
| 1,681,834 | 8/1928 | Arends | 292/338 X |
| 2,515,364 | 7/1950 | Weaver | 292/288 X |
| 3,430,911 | 3/1969 | Olson | 248/354 R |
| 3,583,743 | 6/1971 | Newell | 292/339 |

FOREIGN PATENTS OR APPLICATIONS

| | | | |
|---|---|---|---|
| 1,240,904 | 8/1960 | France | 248/354 S |

*Primary Examiner*—Lawrence J. Staab
*Attorney, Agent, or Firm*—Clarence A. O'Brien; Harvey B. Jacobson

[57] ABSTRACT

A door security guard device having a main adjustable telescoping body with a finer adjusting means consisting of screw-threaded mechanism for attachment between a doorknob and the adjacent flooring. A third point hook-up between the lower floor-engaging portion and the doorjamb is also provided.

6 Claims, 3 Drawing Figures

18
14
16
20
22
32
12
10
25
40
26
36
30
38

3
15
18
17
22
32
3
22
34
12

18
14
16
20
24
28
27
25
29
26
38
36
40
30

DOOR SECURITY GUARD

BACKGROUND OF THE INVENTION

1. Field of the Invention

This invention relates to a device for securing a door firmly against opening as a means of protection for the people inside the door.

2. Description of the Prior Art

Security devices to protect the occupants of houses, stores, etc. are many in number. A number of these devices are used to secure and/or lock doors against opening. A number of them also have adjusting features so that doors of various sizes and heights may be secured with the same unit. However, none of the prior art shows the unique structure as disclosed herein by the applicant. Patents which may be pertinent to this invention are listed as follows: U.S. Pat. Nos. 467,589; 598,405; 132,922; 1,332,473; 1,681,834; and 3,583,743.

SUMMARY OF THE INVENTION

An object of the present invention is to provide a security door guard to prevent the opening of a door.

Another object of the present invention is to provide a door guard device which may be adjusted for use with doors of varying sizes.

A still further object of this invention is to provide adjustable door securing means wherein the ends of said securing means are positively engaged with the door and the adjacent floor.

A still further object of this invention is to provide door securing means which is positively restrained from slipping out of locking position.

The door securing guard as disclosed in this application is unique and different from previous door guards in that it is much more fully adjustable than known door guards have been in the past and it has the additional feature of being positively secured from slipping out of locking engagement with said floor.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3:
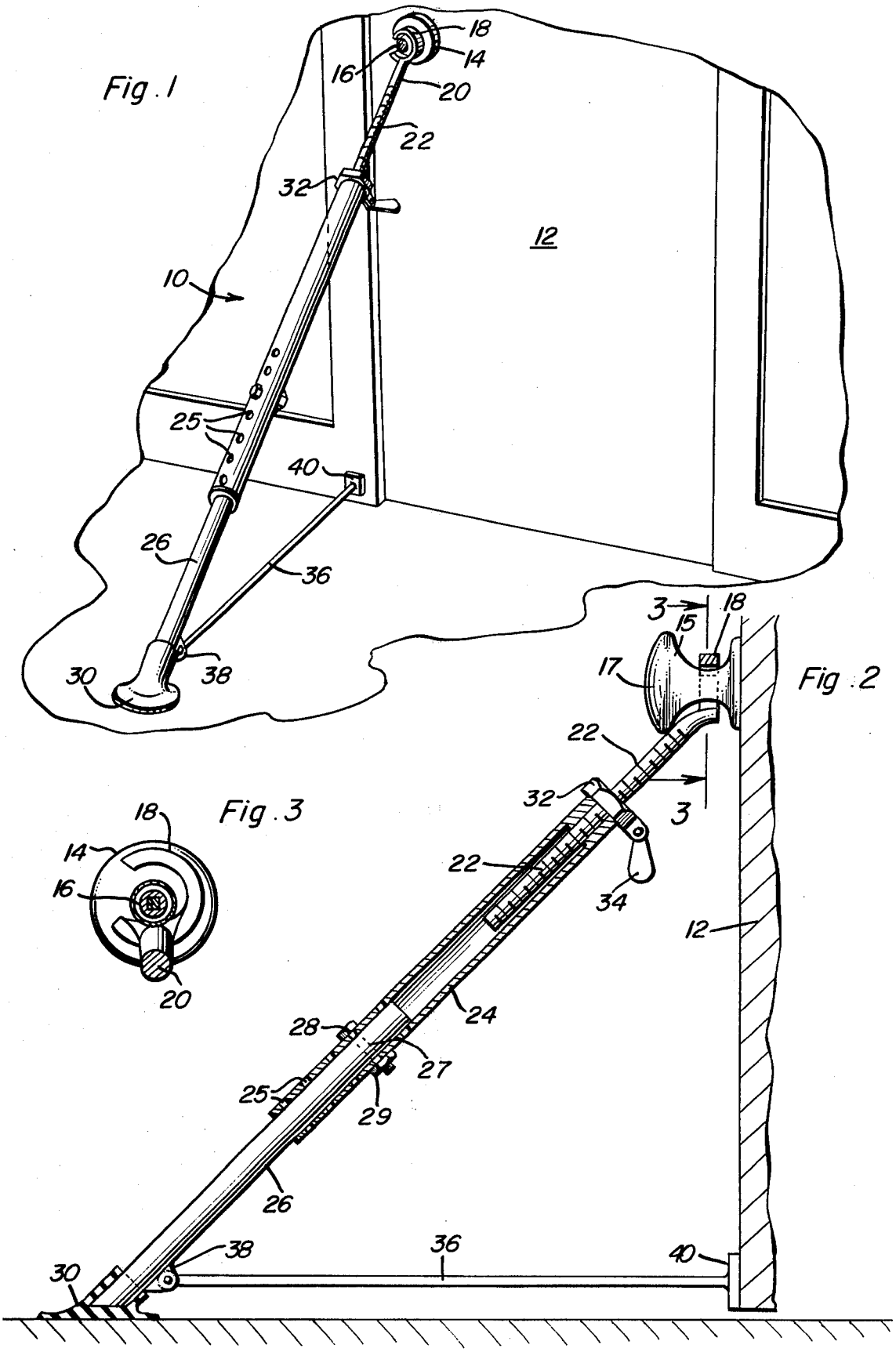
FIG. 1 shows a perspective view of this invention as used to secure a door against opening.
FIG. 2 shows a vertical elevation, partly in cross section, of the door guard of FIG. 1.
FIG. 3 shows a cross-sectional view taken generally along line 3—3 of FIG. 2.

Reference is now made to the drawings wherein reference numeral 10 refers to the door guard of this invention shown in general use for locking the opening of a door. FIG. 1 shows a door 12 which would normally open inwardly, i.e. toward the viewer. A decorative plate 14 covers the internal doorknob mechanism with a shaft 16 being connected thereto. The doorknob itself 17, as seen in FIG. 2, has a reduced portion 15 inwardly thereof. This is the common construction of known doorknobs, and does not form a part of this invention as such.

The doorknob engaging portion of the guard device consists of a bar member 20 having screw threads 22 along one end thereof and a hook-shaped portion 18 which substantially surrounds and engages the reduced portion 15 of the doorknob structure. The main body portion of the guard device comprises a hollow tube 24 having holes 25 spaced along one end thereof, and an inner rod member 26 which telescopes into main body member 24. One or more holes 27 are provided in one end of rod 26 for alignment with the holes 25 for rough adjustment purposes. That is, to quickly and roughly adjust the doorguard device to the proper length for efficient and secure use thereof, the inner telescoping rod 26 is slid to the appropriate position within tube 24, the inner and outer holes (25, 27) are sligned, and then a locking bolt 28 with locknut 29 thereon is used to secure the telescoping portions in proper position.

The other end of rod 26 has a foot member 30 fastened thereto. This foot member may be of rubber, plastic, or other known material, preferably of skid resistant type. This foot member engages the floor 2 or 3 feet from the door and secures the lower end of the guard device from slipping inwardly and allowing the door to open.

In operation the hook portion 18 of the guard device is attached around the doorknob, the lower end foot portion 30 is placed an appropriate distance from the base of the door and the rough adjustment by means of telescoping member 24 and rod 26 is made and said adjustment locked with the bolt 28. After this a fine adjustment of the guard device may be made by rotating adjusting nut 32 by means of handle 34 around the threaded portion 22 of rod 20. As can be visualized rotation of nut 32 will either increase or decrease tension of the device against the doorknob. The device may be used as just described.

However, a further important feature of the disclosed invention is to provide a third contact point between the first contact point of the floor and the second contact point of the doorknob. This third point is provided by bar 36 which is fastened to the rod 26 near the foot portion by means of connection 38 and also fastened against the doorjamb close to the bottom of the door by means 40. Any known type fastening devices may be utilized for points 38 and 40, but, ones of a pivotable type are to be preferred. As can be visualized by use of this third point of securing the foot 30, it is positively prevented from slipping away from the holding position. Thus this new and novel device will positively secure the door from opening even though a possible intruder will shake and vibrate the door and knob from the other side.

As shown and disclosed in this application the security door guard invention herein may be utilized in both a two-point hook-up manner as well as the more positive three-point hook-up manner. The difference in distance between the base of the door and the foot 30 will vary depending on the type of hook-up being utilized. A general formula for proper use of the device is as follows: to find the proper distance for the foot 30 from the base of the door on a two-point hook-up, measure the height of the doorknob from the base of the door and divide by 2.6. The answer will be the approximate distance that the foot 30 should be placed from the base of the door. Similarly if a three-point hook-up is going to be used, divide the height of the doorknob from the base of the door by the factor of 1.75 and the answer will again be the approximate distance the foot 30 should be placed from the base of the door. The device of this invention is useful for all types of doors inside of homes, offices, shops, stores, warehouses, etc. It is readily adaptable to many different applications and many different sizes and arrangements of doors.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A security guard device for a door mounted in a doorjamb; a main adjustable body structure, second adjustable means provided thereon for permitting a fine adjustment of the device, means for attaching the device to a door, and further means for engaging the floor to thereby prevent the door from being opened, still further means to prevent the means for engaging the floor from slipping on same, and the means for engaging the floor including a floor-engaging foot and the still further means preventing slipping being an additional member of solid material attached between the foot and the doorjamb.

2. A security guard device for a door mounted in a doorjamb; a main adjustable body structure, second adjustable means provided thereon for permitting a fine adjustment of the device, means for attaching the device to a door, and further means for engaging the floor to thereby prevent the door from being opened, still further means to prevent the means for engaging the floor from slipping on same, the means for engaging the floor includes a floor-engaging foot and the still further means preventing slipping is an additional member between the foot and the doorjamb, and the additional member is pivotally mounted to the foot portion of the device and the doorjamb.

3. A security guard device for a door mounted in a doorjamb; a main adjustable body structure, second adjustable means provided thereon for permitting a fine adjustment of the device, means for attaching the device to a door, and further means for engaging the floor to thereby prevent the door from being opened, said attaching means to the doorknob being a hook-shaped member which substantially engages and surrounds the inner reduced portion of the knob of the door, said main adjustable body structure comprising inner and outer telescoping tubes with locking means to maintain the adjustment thereof, said second adjustable means provided on the main body structure including a screw-threaded rod having an adjusting nut thereon resting against the upper end of the outer telescoping tube, said floor-engaging means being a foot of non-skid material, together with still further means to prevent the foot engaging the floor from slipping on same and the still further means includes an additional rigid member pivotally attached between the foot and the doorjamb for securely preventing the foot from slipping away from the base of the door.

4. The device of claim 2 wherein the attaching means to the door is a hook-shaped member which substantially engages and surrounds the inner reduced portion of the knob on the door.

5. The device of claim 4 wherein the main adjustable body structure comprises telescoping tubes with locking means to maintain the adjustment thereof.

6. The device of claim 5 wherein the second adjustable means provided on the main body structure includes a screw-threaded rod having an adjusting nut thereon resting against one end of one of the telescoping tubes.

* * * * *